US007481590B2

(12) United States Patent
Takagi

(10) Patent No.: US 7,481,590 B2
(45) Date of Patent: Jan. 27, 2009

(54) PRINTER APPARATUS

(75) Inventor: Masaaki Takagi, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 432 days.

(21) Appl. No.: 11/314,503

(22) Filed: Dec. 21, 2005

(65) Prior Publication Data

US 2006/0153623 A1 Jul. 13, 2006

(30) Foreign Application Priority Data

Jan. 11, 2005 (JP) ..... 2005-004211

(51) Int. Cl.
*B41J 13/02* (2006.01)
*B41J 13/08* (2006.01)

(52) U.S. Cl. ..... 400/637; 400/625; 492/28

(58) Field of Classification Search ..... 400/625, 400/637; 492/28, 49, 56; 271/314
See application file for complete search history.

(56) References Cited

U.S. PATENT DOCUMENTS 5,553,845 A * 9/1996 Sawa et al. ..... 271/314
2006/0034649 A1* 2/2006 Han et al. ..... 400/637

FOREIGN PATENT DOCUMENTS

JP 10-077147 * 3/1998
JP 2002-154702 5/2002

OTHER PUBLICATIONS

Korean Patent Application- 10-2004-0064224, Inventor- Han et al., Date- Aug. 16, 2004, Applicants- Samsung Electronic CO, Ltd.*
Patent Abstracts of Japan, Application No. 2002-154702, dated May 28, 2002 (1 page).

* cited by examiner

*Primary Examiner*—Daniel J Colilla
*Assistant Examiner*—Marissa L Ferguson-Samreth
(74) *Attorney, Agent, or Firm*—Osha • Liang LLP

(57) ABSTRACT

In a printer body 2 of a printer apparatus 1, a grid roller 4 for feeding a sheet of paper 10 and a press roller 8 are arranged. Grid roller 4 is formed to have a large diameter portion and a small diameter portion smaller in diameter than the large diameter portion. The sheet of paper 10 pressed by press roller 8 toward grid roller 4 comes to be fed by the large diameter portion. The small diameter portion is formed at a portion that corresponds to a corner portion of the sheet of paper 10. Grid roller 4 is formed of a metal pipe, a resin layer coated on the surface of the pipe, and ceramic particles applied to the resin layer. Thus, a printer apparatus, in which skew of even a dog-eared paper is corrected, is obtained.

4 Claims, 8 Drawing Sheets

PRINTER APPARATUS

BACKGROUND OF THE INVENTION

1. Field of the Invention

The present invention relates to a printer apparatus and, more specifically, to a printer apparatus including a grid roller and a press roller for paper feeding.

2. Description of the Background Art

A printer apparatus including a grid roller and a press roller as a paper feeding mechanism has been known. This type of printer apparatus has a grid roller 104 and a press roller 108 pressing a sheet of paper onto grid roller 104 arranged as shown in FIG. 14. On a surface of grid roller 104, ceramic particles are applied to increase friction with the sheet of paper 110 fed thereto and to reliably feed the sheet of paper 110.

At the time of printing on paper 110, paper 110 is fed toward grid roller 104, while grid roller rotates, at first, in a direction opposite to the paper-feed direction. Accordingly, when a tip-end of paper 110 reaches a gap between grid roller 104 and press roller 108, the paper is not immediately fed through the gap, but first subjected to skew correction, by which positional deviation of paper 110 is corrected so that the front end of paper 110 is positioned parallel to the axis of rotation of grid roller 104, in case where paper 110 is fed askew.

After skew correction of paper 110, grid roller starts rotation in the opposite direction, and paper 110 is fed out from the gap between grid roller 104 and press roller 108, and printing is done on paper 110. In this type of printing apparatus, printing on the paper is done in the manner described above. Japanese Patent Laying-Open No. 2002-154702 proposes a paper feeding apparatus having the skew correction function.

Sheets of paper for printing may have front-end portion bent or warped (dog-eared). Particularly, envelopes tend to have corners bent, because they are gummed. The printer apparatus described above suffers from the following problem when printing is to be done on a sheet of paper having a tip end portion bent or warped.

First, assume that paper 110 fed toward grid roller 104 has its tip end portion bent (dog-eared) as shown in FIGS. 15 and 16. When the tip end of paper 110 as such comes close to the gap between grid roller 104 and press roller 108, it follows that the bent portion 110*a* of paper 110 comes to be in contact with the surface of grid roller 104 earlier than the portion that is not bent. At this time, grid roller 104 is rotating in a direction (arrow 122) opposite to the paper feed direction (arrow 121), and therefore, paper feed of the dog-eared side of paper 110 is hindered as compared with the side not having the bent corner.

Consequently, the paper (in solid line), of which skew supposed to be corrected as shown by the dotted line 125, is skewed. When grid roller 104 starts rotation in the direction of arrow 123 as shown in FIGS. 19 and 20 in this state, paper 110 comes to be fed much skewed from the originally intended state (dotted line 126). As a result, printing on the paper 110 is also skewed.

SUMMARY OF THE INVENTION

The present invention was made to solve the above-described problem and its object is to provide a printer apparatus in which skew of even a dog-eared sheet of paper can surely be corrected.

The printer apparatus in accordance with the present invention has a printer body for printing on a prescribed sheet of paper, a grid roller, and a press roller. The grid roller is arranged in the printer body for feeding the sheet of paper. The press roller is arranged opposite to the grid roller, and presses the sheet of paper toward the grid roller. The grid roller is formed to have a metal pipe, a resin layer and ceramic particles. The resin layer is formed on the pipe surface. The ceramic particles are applied to the resin layer. The grid roller has a large diameter portion for feeding the sheet of paper and a small diameter portion smaller in diameter than the large diameter portion. The small diameter portion is formed at a portion corresponding to a corner portion of the sheet of paper.

In this structure, the grid roller has a large diameter portion for feeding the sheet of paper and a small diameter portion smaller in diameter than the large diameter portion that corresponds to the corner portion of the paper, and therefore, even when a sheet of paper having tip end corner bent is fed thereto, the bent (dog-eared) portion is not brought into contact with the grid roller. Therefore, paper feed of the dog-eared side of the paper is not hindered as compared with the side not bent of the paper, and prescribed skew correction is performed on the paper. Thus, skewed paper feed is prevented, and satisfactory printing on the paper becomes possible.

The printer apparatus in accordance with another aspect of the present invention has a printer body for printing on a prescribed sheet of paper, a grid roller, and a press roller. The grid roller is arranged in the printer body for feeding the sheet of paper. The press roller is arranged opposite to the grid roller, and presses the sheet of paper toward the grid roller. The grid roller includes a first region for feeding the paper with a prescribed friction with the paper, and a second region of which friction with the paper is smaller than that in the first region. The second region is formed at a portion that corresponds to the corner portion of the paper.

In this structure, even when a dog-eared paper is fed and the dog-eared portion is brought into contact with the second region of the grid roller, paper feed of the dog-eared side of the paper is not hindered as compared with the side not bent of the paper as the friction force is weak. Thus, prescribed skew correction is performed on the paper, skewed paper feed is prevented, and satisfactory printing on the paper becomes possible.

In order to prevent the dog-eared portion from being brought into contact with the grid roller, preferably, the first region is formed as a large diameter portion of a prescribed diameter, and the second region is formed as a small diameter portion smaller in diameter than the large diameter portion.

When the grid roller is formed to include a cylindrical member, a resin layer formed on the surface of the cylindrical member and ceramic particles applied to the resin layer, the diameter of the cylindrical member at the smaller diameter portion should preferably be made smaller in diameter than the large diameter portion of the cylindrical member, or the thickness of the resin layer at the small diameter portion is made thinner than the resin layer at the large diameter portion.

In order to decrease friction force when the dog-eared portion happens to be brought into contact with the grid roller, preferably, the ceramic particles are not applied to the second region but applied to the first region.

In that case, if the grid roller is formed to include a resin layer formed on the surface of the cylindrical member, preferably, the ceramic particles are applied to the resin layer positioned on the first region.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
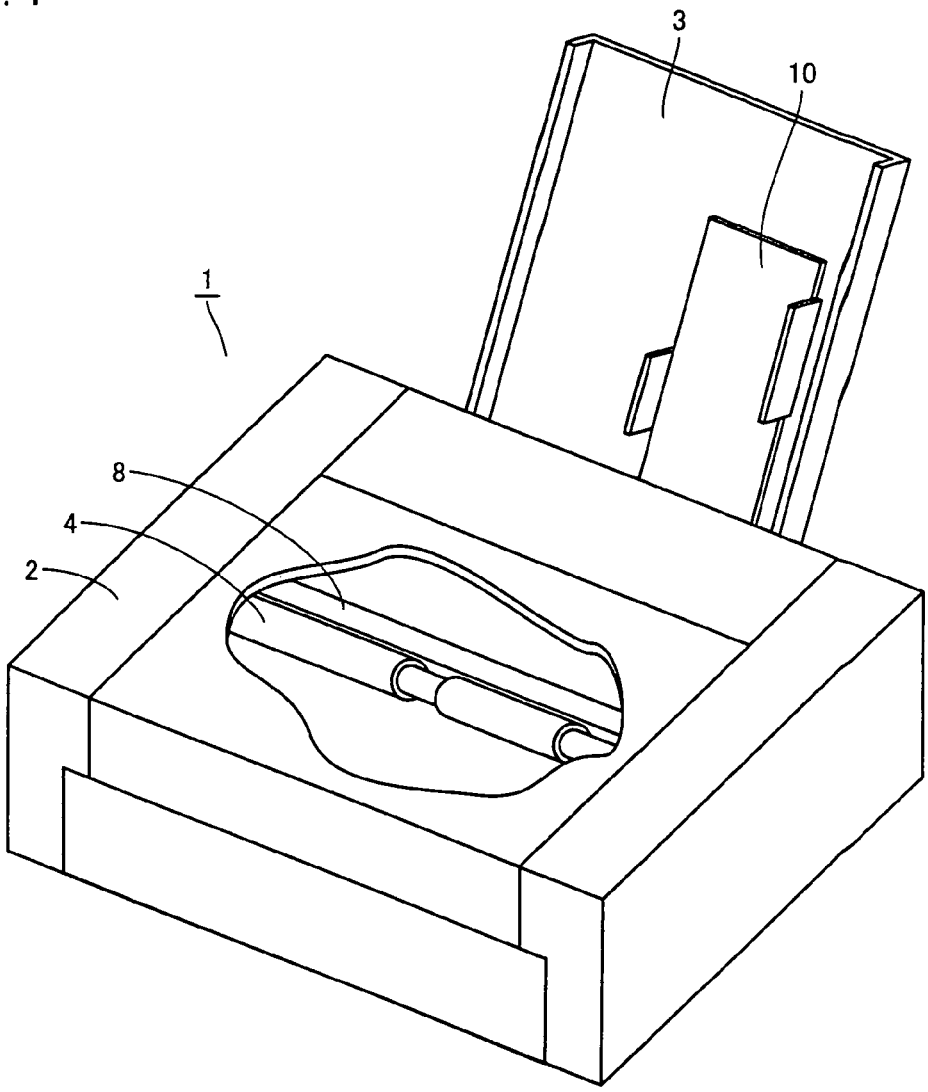
FIG. 1 is a perspective view of the printer apparatus in accordance with an embodiment of the present invention.

The printer apparatus in accordance with an embodiment of the present invention will be described. As shown in FIG. 1, a printer apparatus 1 includes a printer body 2 for printing on a sheet of paper, and a paper support 3 for feeding the sheet of paper is attached to printer body 2. Paper support 3 supports a sheet of paper 10 having a prescribed size. In printer body 2, a grid roller 4 and a press roller 8 for feeding the paper 10 supplied from paper support 3 are arranged.

Figure 2:
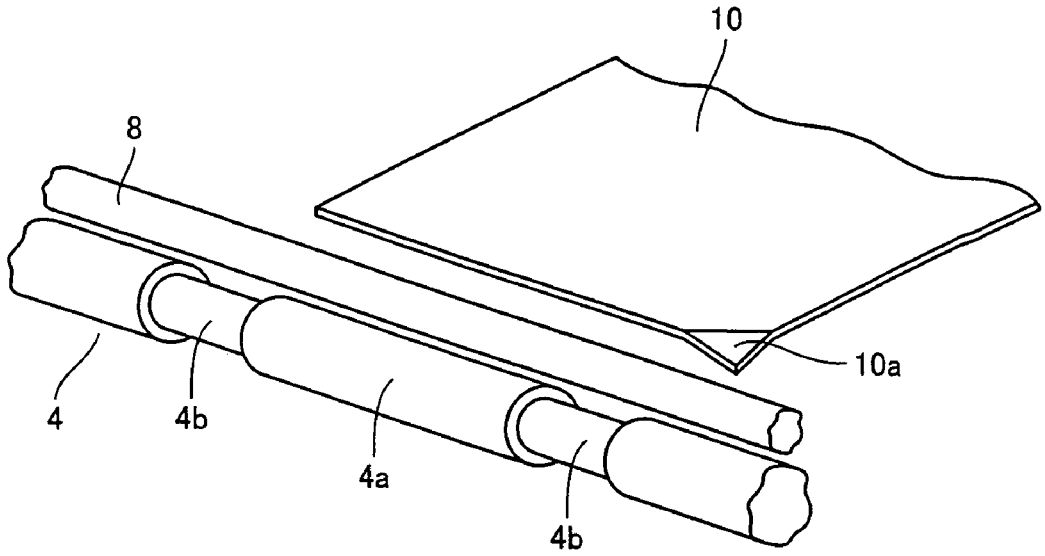
FIG. 2 is an enlarged partial perspective view showing portions of the grid roller and the press roller in the printer apparatus shown in FIG. 1.
Figure 3:
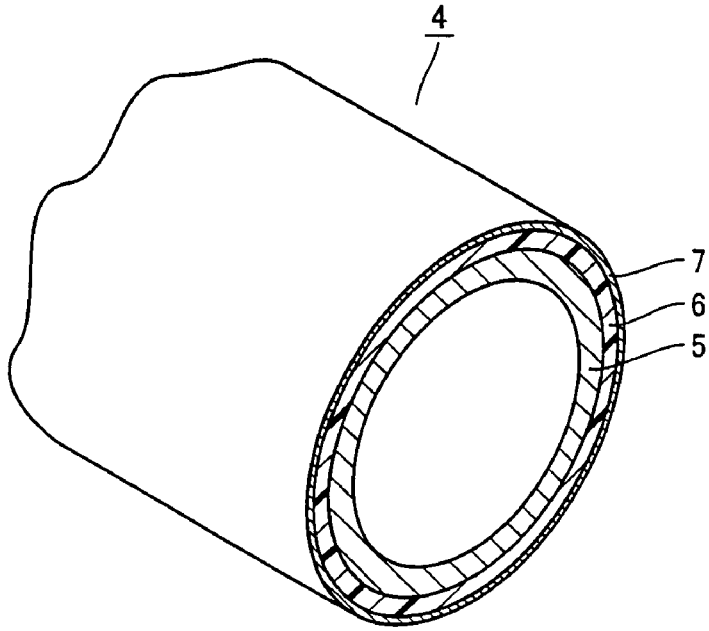
FIG. 3 is an enlarged partial cross-sectional perspective view showing the structure of the grid roller.

Grid roller 4 has a large diameter portion 4*a* and a small diameter portion 4*b* smaller in diameter than large diameter portion 4*a*, as shown in FIG. 2. Paper 10 pressed by press roller 8 toward grid roller 4 will be fed by large diameter portion 4*a*. Small diameter portion 4*b* is formed as a portion that corresponds to a corner of paper 10. As shown in FIG. 3, grid roller 4 is formed of a metal pipe 5, a resin layer 6 coated on the surface of pipe 5, and ceramic particles 7 applied to resin layer 6.

Figure 4:
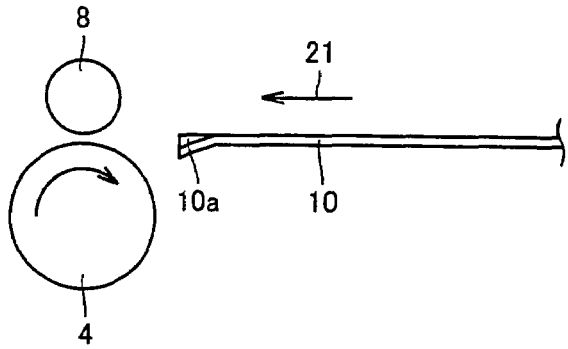
FIG. 4 is a side view showing a first state illustrating the operation of the printer apparatus in accordance with the embodiment.
Figure 5:
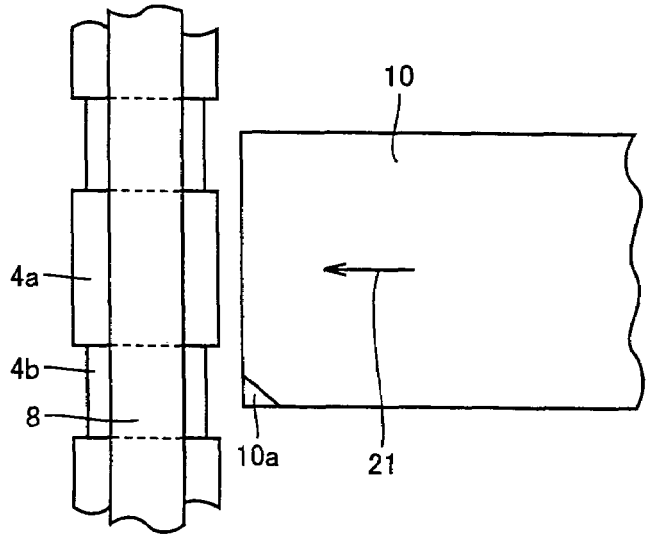
FIG. 5 is a top view of the first state shown in FIG. 4 of the same embodiment.
Figure 6:
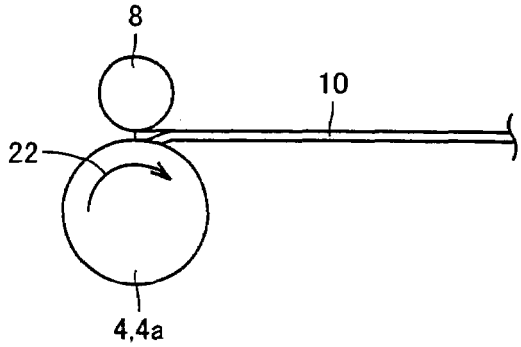
FIG. 6 is a first side view showing a second state illustrating the operation of the printer apparatus in accordance with the embodiment.

Next, an operation of the printer apparatus will be described, assuming that printing is done on paper 10 having a bent portion (dog-ear) 10*a* at the tip end corner, as shown in FIG. 2. First, as shown in FIGS. 4 and 5, paper 1 is fed toward grid roller 4 as represented by an arrow 21, while grid roller 4 is rotating in a direction (arrow 22) opposite to the paper feed direction (arrow 21). Thereafter, as shown in FIG. 6, the tip end of sheet 10 comes closer to the gap between grid roller 4 and press roller 8, and the bent portion (dog-ear) 10*a* of paper 10 is about to be in contact with the surface of grid roller 4 earlier than the other tip end that is not bent.

Figure 7:
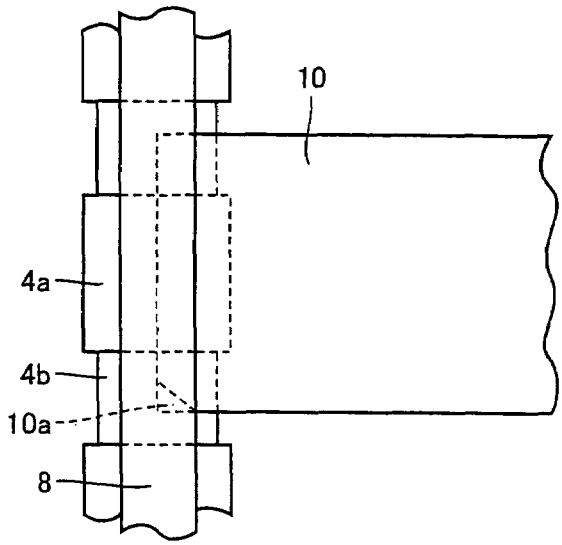
FIG. 7 is a top view of the second state shown in FIG. 6 of the same embodiment.
Figure 8:
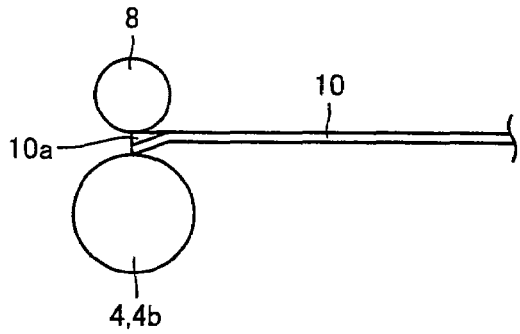
FIG. 8 is a second side view of the second state shown in FIG. 6 of the same embodiment.

At this time, at the portion of grid roller 4 that corresponds to the corner of paper 10, small diameter portion 4*b* having smaller diameter than large diameter portion 4*a* is formed, and therefore, contact of bent portion 10*a* and grid roller 4 can be prevented. Even when the bent portion 10*a* happens to contact, friction between paper 10 and grid roller 4 is significantly reduced. Therefore, paper feed of the dog-eared side 10*a* of the paper 10 is not hindered as compared with the side not bent of the paper 10, and prescribed skew correction of paper 10 is performed, as shown in FIG. 7.

Figure 9:
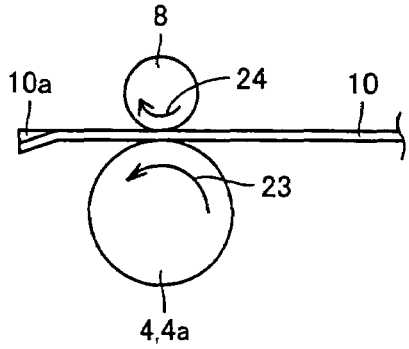
FIG. 9 is a side view showing a third state illustrating the operation of the printer apparatus in accordance with the embodiment.
Figure 10:
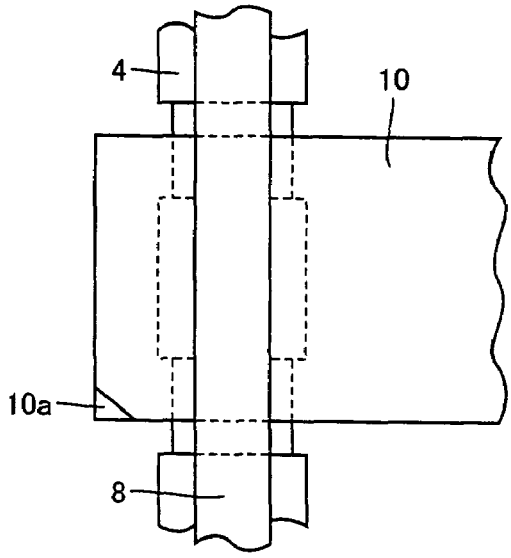
FIG. 10 is a top view of the third state shown in FIG. 9.
Figure 11:
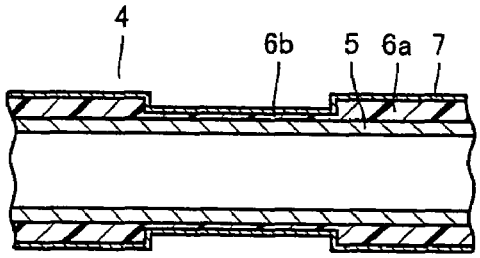
FIG. 11 is a cross-sectional view showing the structure of the grid roller.
Figure 12:
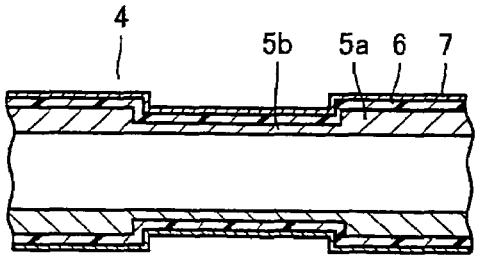
FIG. 12 is a cross-sectional view showing another structure of the grid roller.
Figure 13:
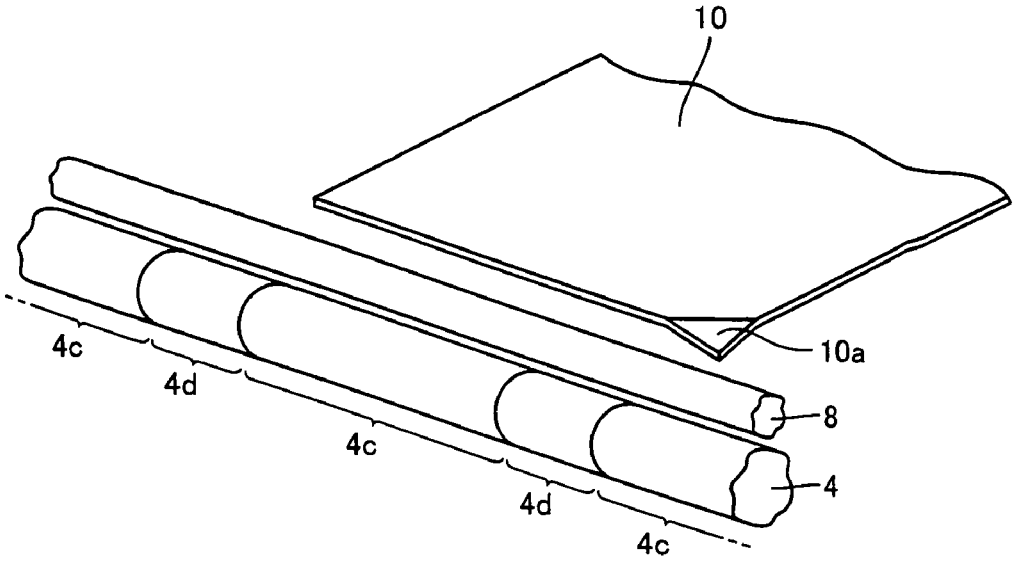
FIG. 13 is an enlarged partial perspective view showing a grid roller in a printer apparatus in accordance with a modification of the embodiment.
Figure 14:
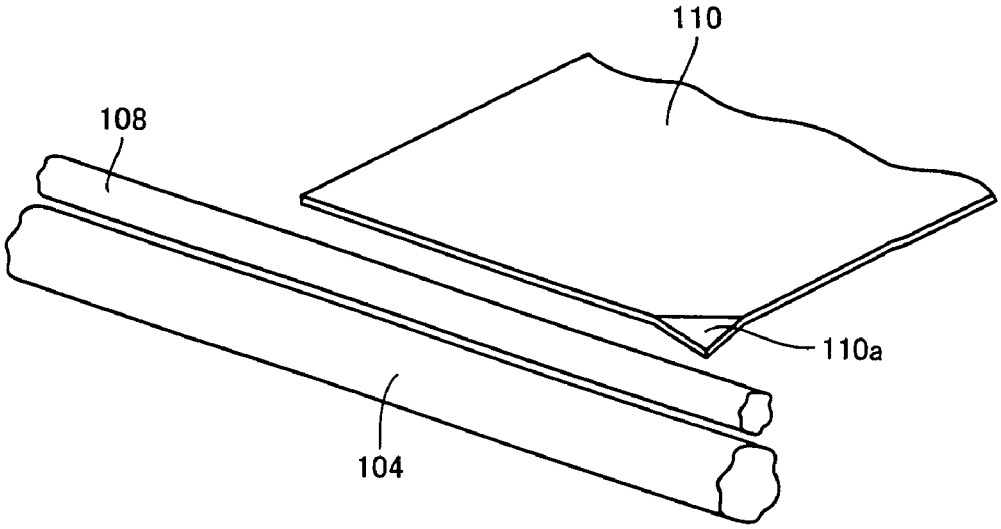
FIG. 14 PRIOR ART
FIG. 14 is an enlarged partial perspective view showing portions of the grid roller and the press roller in a conventional printer apparatus.
Figure 15:
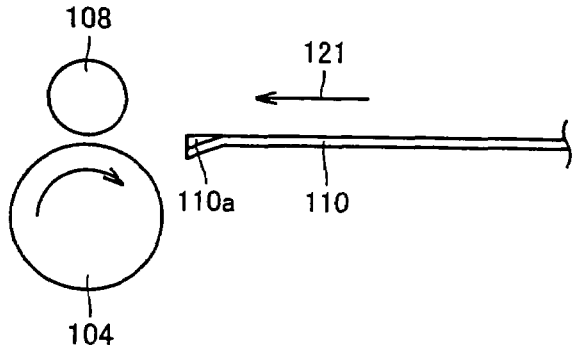
FIG. 15 PRIOR ART
FIG. 15 is a side view showing a first state illustrating the operation of the conventional printer apparatus.
Figure 16:
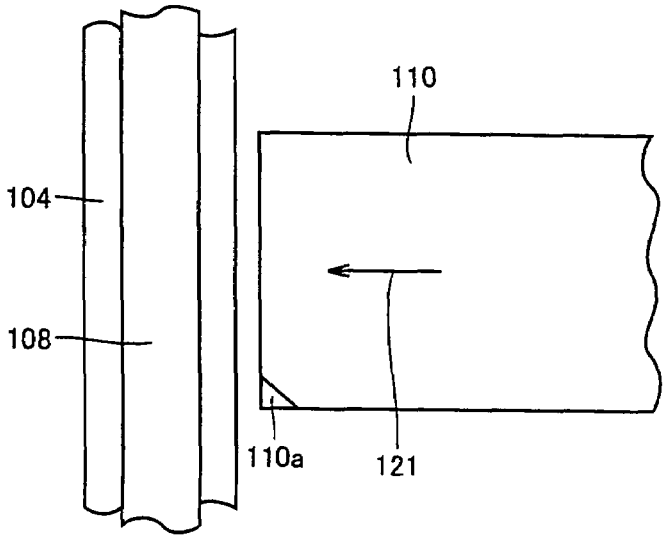
FIG. 16 PRIOR ART
FIG. 16 is a top view of the first state shown in FIG. 15.
Figure 17:
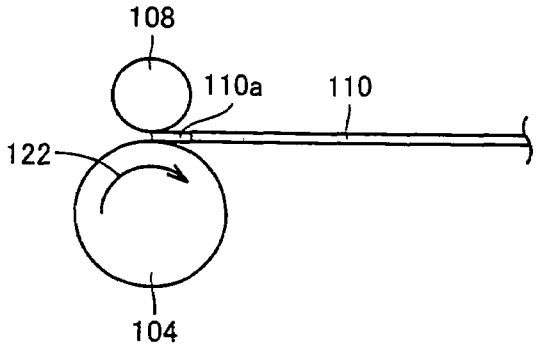
FIG. 17 PRIOR ART
FIG. 17 is a side view showing a second state illustrating the operation of the conventional printer apparatus.
Figure 18:
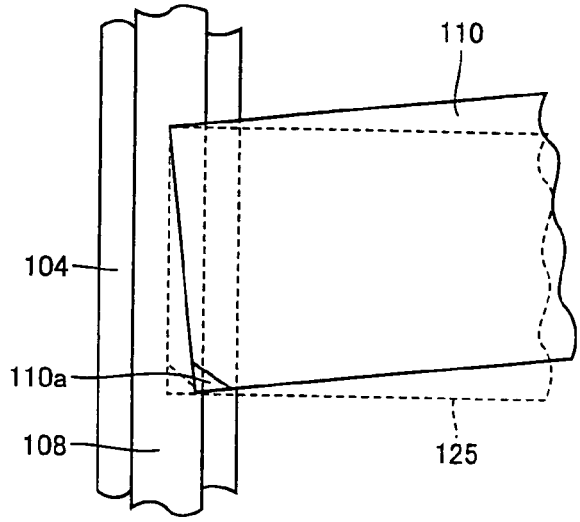
FIG. 18 PRIOR ART
FIG. 18 is a top view of the second state shown in FIG. 17.
Figure 19:
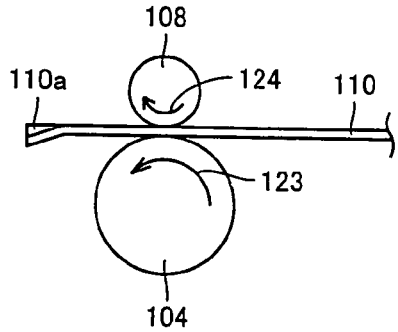
FIG. 19 PRIOR ART
FIG. 19 is a side view showing a third state illustrating the operation of the conventional printer apparatus.
Figure 20:
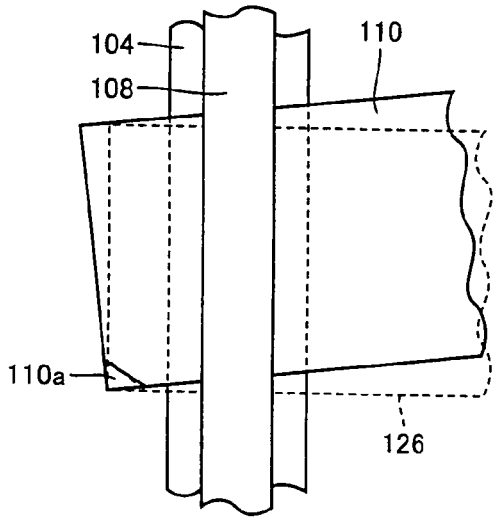
FIG. 20 PRIOR ART
FIG. 20 is a top view of the third state shown in FIG. 19.

After the prescribed skew correction, grid roller 4 starts rotation in the direction of the arrow 23 as shown in FIGS. 9 and 10, paper 10 is fed without skew, and printing is done on paper 10.

In the printer apparatus described above, grid roller 4 is formed to have the large diameter portion 4*a* for feeding the paper and small diameter portion 4*b* smaller in diameter than large diameter portion 4*a* at a portion that corresponds to the corner of paper 10. Therefore, contact of the bent portion 10*a* of dog-eared paper with grid roller 4 can be prevented. Thus, paper feed of the dog-eared side 10*a* of the paper 10 is not hindered as compared with the side not bent of the paper 10, and prescribed skew correction of paper 10 is performed. As a result, skewed feeding of paper 10 is prevented, and satisfactory printing can be done on paper 10.

In the printer apparatus 1, grid roller 4 having large diameter portion 4*a* and small diameter portion 4*b* have been described as an example. The large diameter portion 4*a* and small diameter portion 4*b* may be formed by making the thickness of a portion 6*b* of resin layer positioned at the small diameter portion thinner than the portion 6*a* of resin layer positioned at the large diameter portion. Alternatively, the thickness of a portion 5*b* of the pipe positioned at the small diameter portion may be made thinner than a portion 5*a* of the pipe positioned at the large diameter portion.

In place of such a grid roller 4 having large diameter portion 4*a* and small diameter portion 4*b*, a grid roller 4 may be used in which ceramic particles are not applied to a surface of a region 4*d* that corresponds to a corner of paper 10 and applied to regions 4*c* other than the region 4*d*.

In the region 4*d* where ceramic particles are not applied, friction force with paper 10 decreases as compared with the region 4*c* to which ceramic particles are applied. Therefore, even when the bent portion (dog-ear) 10*a* at the corner of the paper comes to be in contact with the region 4*d* of grid roller 4, paper feed of the dog-eared side of the paper is not hindered as compared with the side not bent of the paper as the friction force is weak. Thus, prescribed skew correction is performed on the paper 10, skewed feeding of paper 10 is prevented, and satisfactory printing on the paper 10 becomes possible.

Though a printing operation of the printing apparatus on paper that tends to be bent such as an envelope has been described as an example, it is needless to say that appropriate skew correction is performed and satisfactory printing is possible on a sheet of paper that is not bent.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printer apparatus, comprising:

a printer body for printing on a prescribed sheet of paper;

a grid roller arranged in said printer body for feeding the sheet of paper; and a press roller arranged opposite to said grid roller for pressing the sheet of paper toward said grid roller;

wherein said grid roller is formed to have a metal pipe, a resin layer formed on a surface of said pipe, and ceramic particles applied to said resin layer;

wherein said grid roller includes a large diameter portion for feeding the sheet of paper, and a small diameter portion formed at a portion corresponding to a corner position of the sheet of paper, smaller in diameter than said large diameter portion; and wherein thickness of said resin layer at said small diameter portion is made thinner than thickness of said resin layer at said large diameter portion.

2. A printer apparatus, comprising:

a printer body for printing on a prescribed sheet of paper;

a grid roller arranged in said printer body for feeding the sheet of paper; and a press roller arranged opposite to said grid roller for pressing the sheet of paper toward said grid roller;

wherein said grid roller includes a first region feeding the sheet of paper with a prescribed friction force to said sheet of paper, a second region formed at a portion corresponding to a corner position of the sheet of paper, having friction force to the sheet of paper weaker than that of the first region, a cylindrical member, a resin layer formed on a surface of said cylindrical member, and ceramic particles applied to said resin layer;

wherein said first region is a large diameter portion having a prescribed diameter, said second region is a small diameter portion smaller in diameter than said large diameter portion, and thickness of said resin layer at said small diameter portion is made thinner than thickness of said resin layer at said large diameter portion.

3. The printer apparatus according to claim 2, wherein diameter of said cylindrical member at said small diameter portion is made smaller than diameter of said cylindrical member at said large diameter portion.

4. The printer apparatus according to claim 2, wherein ceramic particles are applied to said first region and ceramic particles are not applied to said second region.

* * * * *